US005853010A

United States Patent [19]

Suh

[11] Patent Number: 5,853,010

[45] Date of Patent: Dec. 29, 1998

[54] EYELASH CURLER

[76] Inventor: Jeong Joo Suh, #134-2202 Olympic Apt., Bangi-dong, Songpa-Ku, Seoul, Rep. of Korea

[21] Appl. No.: 843,353

[22] Filed: Apr. 15, 1997

[30] Foreign Application Priority Data

Dec. 28, 1996 [KR] Rep. of Korea ..... 67112/96

[51] Int. Cl.[6] ..... A45D 2/48

[52] U.S. Cl. ..... 132/217; 132/271; 132/269

[58] Field of Search ..... 132/216, 217, 132/218, 227, 229, 243, 271, 269; 219/222, 223, 225, 227, 228, 229

[56] References Cited

U.S. PATENT DOCUMENTS

| | | | |
|---|---|---|---|
| 1,020,439 | 3/1912 | Norwood | 219/223 |
| 1,527,964 | 2/1925 | Patino | 132/217 |
| 1,665,327 | 4/1928 | Rissinger . | |
| 1,700,198 | 1/1929 | Dumaine | 219/223 |
| 1,925,266 | 9/1933 | Manning . | |
| 2,569,246 | 9/1951 | Marcellus | 132/217 |
| 2,630,516 | 3/1953 | Rausch et al. | 132/217 |
| 2,675,004 | 4/1954 | Bablon . | |
| 3,516,420 | 6/1970 | Porter | 219/225 |
| 3,705,974 | 12/1972 | Nilsson | 132/229 |
| 3,814,113 | 6/1974 | Morane et al. | 132/229 |
| 3,922,521 | 11/1975 | Viegut et al. . | |
| 4,023,579 | 5/1977 | Suroff | 132/272 |
| 4,056,111 | 11/1977 | Mantelet . | |
| 4,212,311 | 7/1980 | Del Valle | 132/217 |
| 4,397,326 | 8/1983 | Formica . | |
| 4,404,977 | 9/1983 | Vasas . | |
| 4,425,161 | 1/1984 | Shibahashi et al. | 106/31.17 |
| 4,469,934 | 9/1984 | Isshiki et al. . | |
| 4,606,342 | 8/1986 | Zamba et al. . | |
| 4,719,931 | 1/1988 | Suzuki . | |
| 4,866,249 | 9/1989 | Howard | 132/243 |
| 4,923,066 | 5/1990 | Ophir et al. | 209/538 |
| 4,939,340 | 7/1990 | Brill | 132/229 |
| 4,964,429 | 10/1990 | Cole . | |
| 5,007,442 | 4/1991 | Hirzel | 132/218 |
| 5,086,793 | 2/1992 | Kingsford . | |
| 5,253,159 | 10/1993 | Bilas et al. | 364/140 |
| 5,590,669 | 1/1997 | McMullen . | |
| 5,652,569 | 7/1997 | Gerstenberger et al. | 340/573 |

FOREIGN PATENT DOCUMENTS

| | | | |
|---|---|---|---|
| 883900 | 7/1943 | France . | |
| 622876 | 5/1949 | United Kingdom | 132/217 |

*Primary Examiner*—Todd E. Manahan
*Assistant Examiner*—Eduardo C. Robert
*Attorney, Agent, or Firm*—Birch, Stewart, Kolasch & Birch, LLP

[57] ABSTRACT

An improved eyelash curling apparatus which is capable of enhancing the reliability of the product and improving the quality of the system. The apparatus includes a brush including a heating member, on which a heating wire is wound, a curved portion which is formed to be matched with curved portions of eyes and eyelashes, with a heat sensitive coating material being coated on an outer surface of the heating member, and with a wider surface being formed in one side of the brush, with safety protrusions being formed in the brush so as to partially expose the heating member, and with an eyelash support portion being protrudely formed on the surface of the brush.

17 Claims, 5 Drawing Sheets

EYELASH CURLER

BACKGROUND OF THE INVENTION

1. Field of the Invention

The present invention relates to an eyelash curling apparatus, and more particularly to an improved eyelash curling apparatus which is capable of more rapidly heating a heating member, visually checking the heating state, and more easily and naturally curling eyelashes after mascara applied to the eyelashes has hardened. The present apparatus provides improved quality and reliability, and in addition makes it possible to more easily curl eyelashes in a short time, while visually checking the function of the system, e.g., preventing a excessive electric power consumption, checking the power of the battery and the like.

2. Description of the Conventional Art

Generally, the conventional eyelash curling apparatus is directed to curling eyelashes by using a curling device, e.g., a brush which utilizes a curling liquid such as mascara, or a tweezers, etc., for applying the curling liquid to the eyelashes. When using an eyelash tweezers, excessive pressure may be applied to the eyelashes, which causes the pulling of out the eyelashes. In addition, when curling the eyelashes by using a heated metal such as a metallic needle, the eyelashes may be over-heated and thus, the skin near the eyelashes may be damaged. Furthermore, when using a curling liquid, the eyelashes may become too hardened, so that it is impossible to naturally curl the eyelashes.

In order to overcome the above-described problems, Korean Patent Application (96-24771) invented by the same inventor as the present application, discloses an eyelash curling apparatus.

FIG. 1 is an exploded perspective view illustrating the eyelash curling apparatus of Korean patent application 96-24771 (U.S. application Ser. No. 08/749,014 filed Nov. 14, 1996) and FIG. 2 is a cross-sectional view thereof.

The eyelash curling apparatus of FIG. 1 includes a main body 1 having a handle 10 and a cover 13. A battery 12 is disposed within the handle 10 of the main body 1. An operation switch 11 disposed in an outer circumferential surface of the main body 1 is connected with a heating tube 20. An indication lamp 23 is disposed in a surface portion of the heating tube 20. A heating member 21 having a heating wire which is spirally wound onto the spiral brush 22 is coated, thus forming the eyelash curling apparatus.

However, this eyelash curling apparatus has the following disadvantages.

First, it is not possible to use the eyelash curling apparatus until after the heating member 21 and the brush 22 are substantially heated, which causes a long waiting time for curling.

Second, since the brush 22 is made in a straight configuration, it is impossible to accurately match the brush 22 with the curved portion of the eye and the eyelash. Thus, people have different curved portions of eyes and eyelashes.

Third, since the brush 22 is formed with a thread, the eyelash may partially contact the heating member 21, making it impossible to uniformly curl the eyelashes.

Fourth, since the eyelash curling apparatus is directed to heating the brush 22 by using the heating member 21, the user must check by hand to determine whether it can be used, which, of course causes inconvenience.

Fifth, since the brush 22 has only the function of heating to soften the mascara applied to the eyelashes and then curling the eyelashes, the eyelash curling apparatus of FIG. 1 has limited functions, thus restricting the usage of the device.

SUMMARY OF THE INVENTION

Accordingly, it is an object of the present invention to provide an eyelash curling apparatus which overcomes the aforementioned problems encountered in the conventional art.

It is another object of the present invention to provide an improved eyelash curling apparatus which can be used for any type of curved portion of the eyes and eyelashes by providing a curved element which matches with the curved portion of the eyes and eyelashes during the curling operation.

It is still another object of the present invention to provide an improved eyelash curling apparatus which is capable of more rapidly curling eyelashes.

It is still another object of the present invention to provide an improved eyelash curling apparatus which is capable of more rapidly hardening a mascara and continuously maintaining the curled eyelashes in a curled form for a long time, while being well adaptable to many types of eyelashes.

It is still another object of the present invention to provide an improved eyelash curling apparatus which is capable of enhancing the convenience and the reliability of the product while improving the quality of the devices.

To achieve the above objects, there is provided an improved eyelash curling apparatus which includes a silicon portion made of a heat sensitive coating material which is coated on the outside surface of the heating member for easily checking the heating state of the device. A curling element which includes a heating member on which a heating wire is wound, has a curved portion which is formed to match with the curved portions of the eyes and eyelashes, with a wide surface being formed on one side of the curling element. Safety protrusions are formed on the curling element so as to partially expose the heating member, and with an eyelash support portion being protrudingly formed on the surface of the curling element, wherein the eyelash curling apparatus includes a main body having a handle portion and a protection cap, a battery disposed within the handle portion of the main body, an operation switch disposed in an outer circumferential surface of the main body, a heating tube connected to the operation switch, and an indication lamp disposed in an upper portion of the heating tube.

Additional advantages, objects and other features of the present invention will be set forth in part in the description which follows and will become apparent to those having ordinary skill in the art or may be learned from practicing the invention. The objects and advantages of the present invention may be realized and attained as particularly pointed out in the appended claims.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
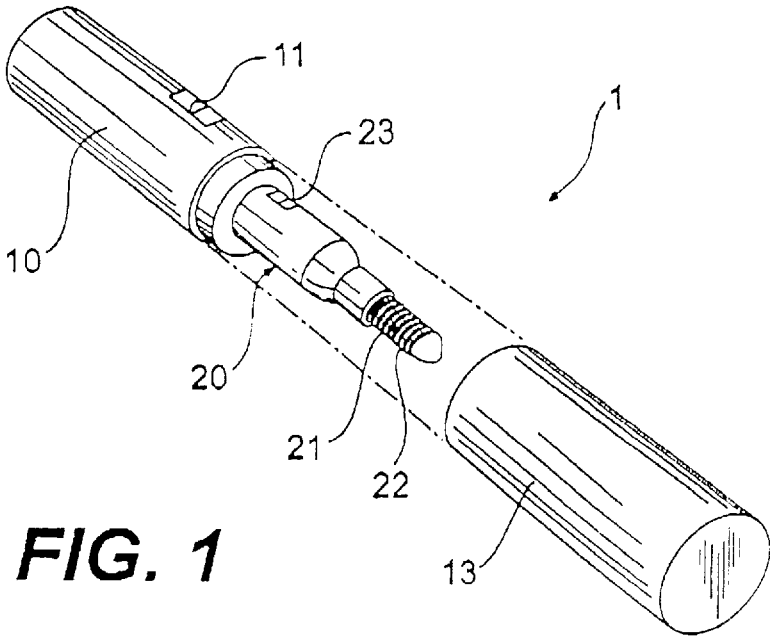
FIG. 1 is an exploded perspective view illustrating a type of eyelash curling apparatus.
Figure 2:
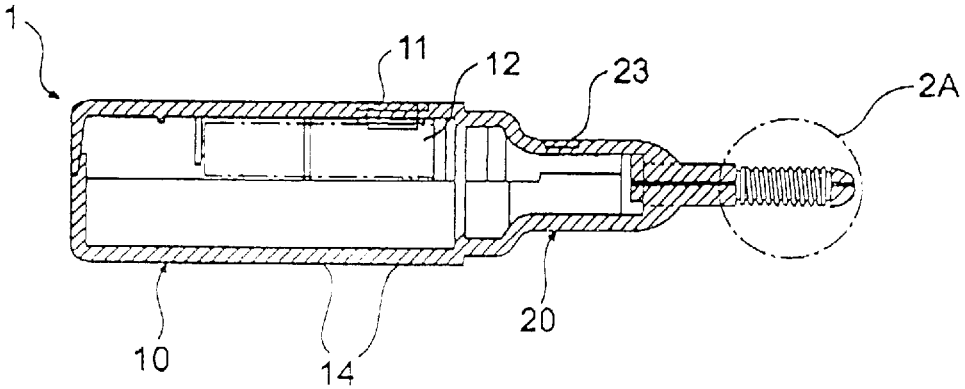
FIG. 2 is a cross-sectional view illustrating the eyelash curling apparatus FIG. 1.
Figure 2A:
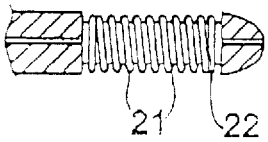
FIG. 2A shows in detail the end portion of the device of FIG. 2.
Figure 3:
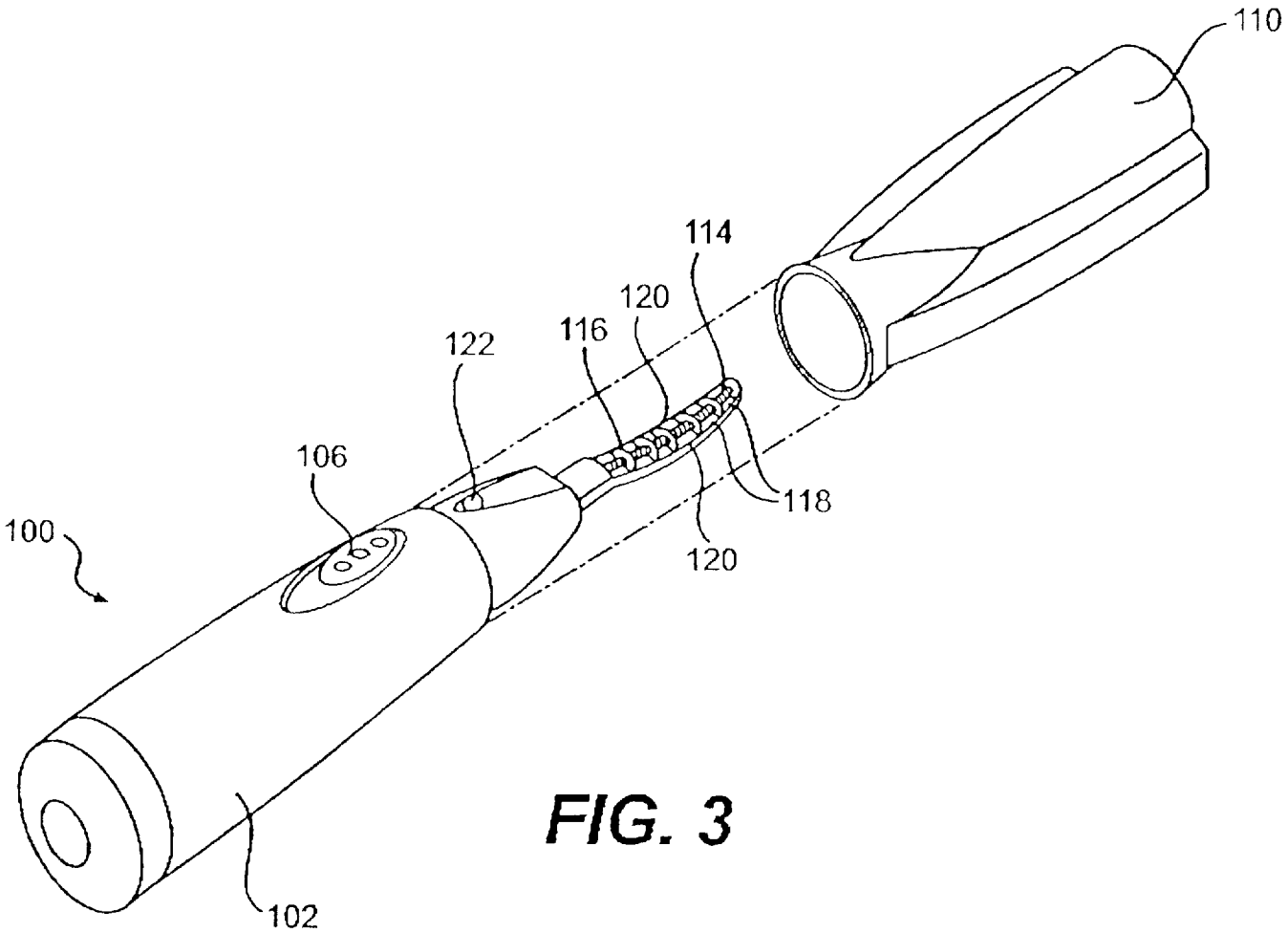
FIG. 3 is an exploded perspective view illustrating the eyelash curling apparatus according to the present invention.

As shown herein, the main body 100 includes a handle 102 and a protection cap 110. A battery 108 is disposed within the handle 102 of the main body 100. A heating tube 112 is electrically connected with an operation switch 106 disposed in an outer circumferential surface of the main body 100. An indication lamp 122 is disposed in an upper portion of the body 100. The curling element 104 includes a heating member 114 which is wound with a heating wire for forming the eyelash curling apparatus. The curling element has a silicon portion 118 having a lower heat transfer rate which is arranged with the heating member 114. Thus, the heating member maintains a temperature of 80° to 120° F., and the silicon portion 118 maintains a temperature of 40°–60° F.

Figure 4:
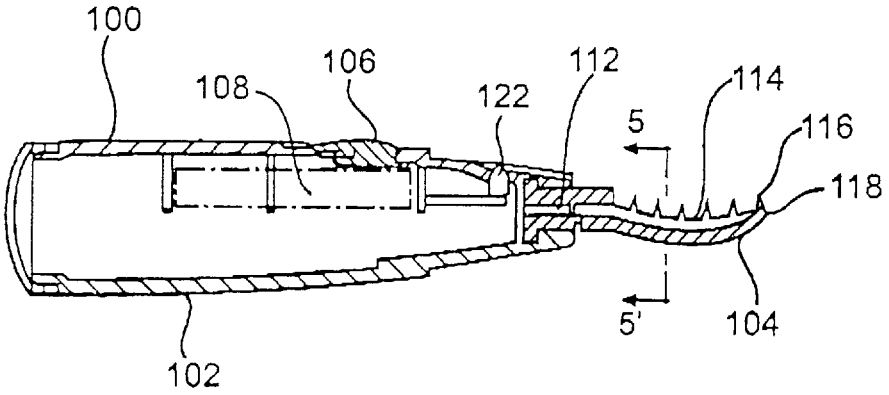
FIG. 4 is a cross-sectional view illustrating the inside construction of an eyelash curling apparatus according to the present invention.
Figure 5:
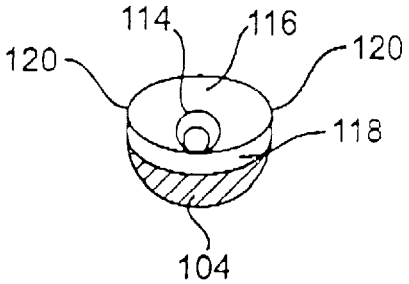
FIG. 5 is a cross-sectional view taken along line A–A' of FIG. 4.
Figure 6:
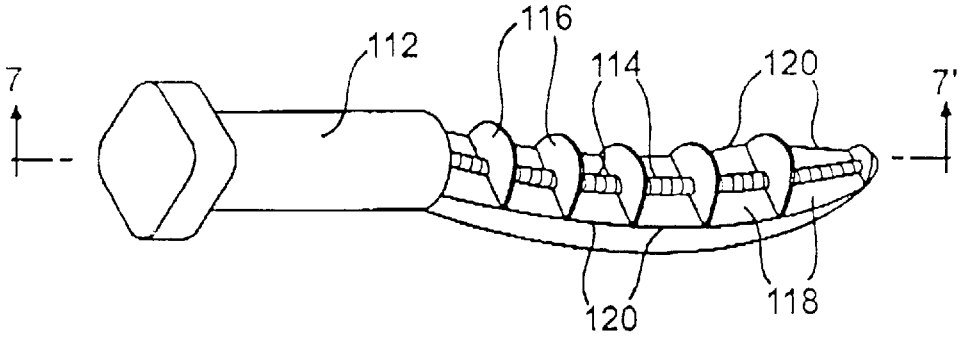
FIG. 6 is a perspective view illustrating the tip portion of the eyelash curling apparatus according to the present invention.
Figure 7:
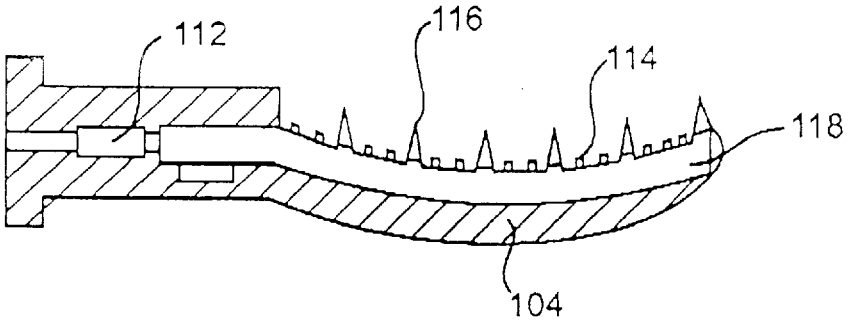
FIG. 7 is a cross-sectional view taken along line B–B' of FIG. 6 in order to illustrate the tip portion of the eyelash curling apparatus according to the present invention.
Figure 8:
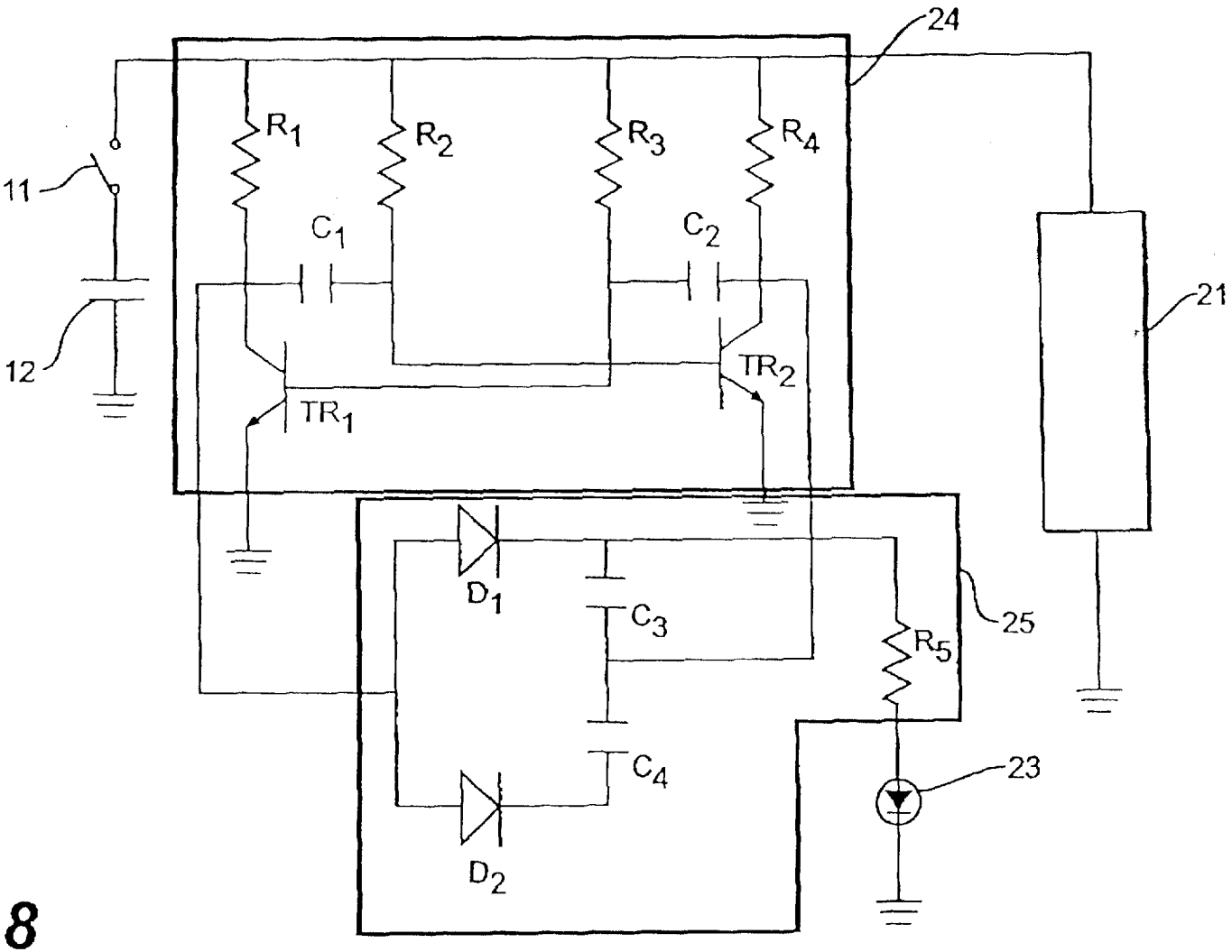
FIG. 8 is a circuit diagram of the electrical circuit of the eyelash curling apparatus according to the present invention.

In addition, the curling element 104 including the heating member 114 has a curved portion which matches with the curved portion of the eyes and eyelashes of a user. A predetermined area is defined on one side of the silicon portion 118 for more easily curling the eyelashes. Safety protrusions 116 are formed on the curling element 104 so as to expose the heating member 114. An eyelash support portion 120 is protrudingly formed on the surface of the curling element 104. As shown in FIG. 4, the indication lamp 122 indicates whether the system is in operation. The heating wire is preferably designed to be operated at current of 0.3A –1A. In addition, it is possible to use the system at 1.1V and for 100 minutes by controlling the length of the heating wire. In addition, the indication lamp 122 may include a circuit 25, including diodes D1, D2, capacitors C3, C4 and resistors R5 for repeatedly turning the lamp on and off, a function for changing the color thereof and an indicating device for indicating the need to change the battery.

In addition, there may be provided a circuit 24, including resistors R1–R4, capacitors C1, C2 and transistors TR1, TR2 for maintaining the temperature of the heating material at 80°~120°.

As described above, the eyelash curling apparatus according to the present invention is basically directed to forming the curling element 104, which has the heating member 114 disposed on the silicon portion 118. The outer surface of which heating member 114 is coated with a heat sensitive coating material, for matching with the curved portion of eyes and eyelashes, whereby it is possible to naturally curl the eyelashes. In addition, the safety protrusions 116 are formed so as to expose the heating member 114, so that it is possible to satisfy a user's desire of having different curved portion of eyes and eyelashes. In addition, the eyelash curling can be performed in a short time by rapidly heating the heating member within a few seconds. The heating state can be visually checked by utilizing the silicon portion 118 which is made of a heat sensitive material on the outer circumferential surface of the heating member 114. Since an eyelash support portion 120 is provided by protrudingly forming the curling element 104, it is possible to more easily harden the eyelash, for naturally supporting the eyelash and curling for any type of eyelash. Because the indication lamp 122 is disposed in the main body 100, if there is an operational problem in the system, it is possible to easily check for such a problem. Moreover, the heating wire is designed to be operated at 0.3A~1A, thus conserving electric power consumption. It is possible to use the system at 1.1V and for 100 minutes by elongating the heating wire. In addition, it is possible to indicate when the battery is to be replaced by providing a circuit for repeatedly turning the indication lamp on/off or by changing the color of the lamp, whereby it is possible to improve the reliability of the product and enhance the quality of the product. The temperature of the heating member is maintained at 80°–120° F.

As described above, the eyelash curling apparatus according to the present invention can be used for any type of curved portion of the eyes and eyelashes by providing a curved curling element which matches with the curved portion of eyes and eyelashes during the eyelash curling operation. Thus, the present device is capable of more rapidly curling eyelashes, more rapidly hardening the mascara on eyelashes and continuously maintaining the curled eyelashes in a curled form for a long period of time. The device of the present invention is thus well adaptable to many types of eyelash for enhancing the convenience and reliability of the product and improving the quality of the system.

Although the preferred embodiments of the present invention have been disclosed for illustrative purposes, those skilled in the art will appreciate that various modifications, additions and substitutions are possible, without departing from the spirit and scope of the invention as recited in the accompanying claims.

What is claimed is:

1. An eyelash curling device which comprises:

a handle portion, a curling element having an elongated flat surface defining an eyelash support portion which extends from said handle portion, said elongated flat surface being curved along its longitudinal axis to correspond with the curvature of the eye and eyelash, a heating means disposed in the middle portion of the elongated flat surface and dividing it into lateral surfaces disposed on opposite sides of the heating means, said heating means extending longitudinally along the length of said elongated surface in conformity with the curved elongated surface, and a plurality of protruding means spaced along said longitudinally extending elongated surface and extending from said elongated surface.

2. The eyelash curling device of claim 1, wherein the curling element is provided with a heat-sensitive coating material which indicates the heating state of the device.

3. The eyelash curling device of claim 2, wherein the heat-sensitive coating material is silicon.

4. The eyelash curling device of claim 2, wherein an electrical circuit is provided for maintaining the heating means at a temperature of 80° to 120° F. and the curling element is correspondingly maintained at a temperature of 40°–60° F.

5. The eyelash curling device of claim 4, wherein said electrical circuit and an indication light are utilized to measure when the battery is to be changed.

6. The eyelash curling device of claim 5, further comprising a circuit for changing a color of the indication light.

7. The eyelash curling device of claim 1, wherein the heating means is a heating member having a heating wire.

8. The eyelash curling device of claim 7, wherein the heating wire is designed to operate at a current of 0.3 A to 1.0 A.

9. The eyelash curling device of claim 7, wherein the heated wire is used at 1.1 V and for more than 100 minutes by elongating the length thereof.

10. The eyelash curling device of claim 1, wherein the handle portion contains a battery which is electrically connected to the heating means for supplying power thereto.

11. The eyelash curling device of claim 10, wherein a switch means is operatively connected to the battery for selectively energizing the heating means.

12. The eyelash curling device of claim 11, wherein an indicator light is operatively connected to the switch means for indicating the operative state of the heating means.

13. The eyelash curling device of claim 1, wherein the curved, elongated surface is provided with a layer of heat-sensitive material having a lower heat transfer rate than that of the heating means.

14. The eyelash curling device of claim 13, wherein the heat-sensitive material is silicon.

15. The eyelash curling device of claim 1, wherein a protective cap houses the curling element and removably engages with the handle portion of the device.

16. The eyelash curling device of claim 1, wherein the lateral surfaces define eyelash support portions which extend the length of the curling element.

17. The eyelash curling device of claim 1, further comprising an indication lamp disposed on the handle portion for indicating a malfunction of the electrical system.

* * * * *